US005721680A

United States Patent [19]

Van Cleve et al.

[11] Patent Number: 5,721,680

[45] Date of Patent: Feb. 24, 1998

[54] MISSILE TEST METHOD FOR TESTING THE OPERABILITY OF A MISSILE FROM A LAUNCH SITE

[75] Inventors: David P. Van Cleve; R. Winston Monk, both of Tucson, Ariz.

[73] Assignee: Hughes Missile Systems Company, Los Angeles, Calif.

[21] Appl. No.: 478,148

[22] Filed: Jun. 7, 1995

[51] Int. Cl.[6] ..... G06F 15/14; F41G 7/00

[52] U.S. Cl. ..... 364/424.012; 364/423.028; 364/551.01; 244/3.11; 244/3.12; 244/3.15; 244/3.2; 324/73.1; 434/11; 434/14

[58] Field of Search ..... 364/424.03, 423, 364/578, 550, 55.01; 324/73.1; 244/3.24, 3.21, 3.1, 3.15, 3.16, 3.11, 3.12, 3.13, 3.14, 3.19, 3.2, 3.22; 89/1.14, 1.11, 1.814, 1.819, 1.8, 1.81; 102/378, 498, 293, 388, 215–218; 434/21, 12, 22, 11, 14; 73/167, 865.6

[56] References Cited

U.S. PATENT DOCUMENTS

| | | | |
|---|---|---|---|
| 4,031,806 | 6/1977 | Stark et al. | 244/31 |
| 4,745,840 | 5/1988 | Long | 89/1.814 |
| 4,935,881 | 6/1990 | Lowenson et al. | 364/578 |
| 5,224,860 | 7/1993 | Waldman et al. | 434/21 |
| 5,294,078 | 3/1994 | Gurr | 244/116 |
| 5,414,347 | 5/1995 | Monk et al. | 324/73.1 |
| 5,490,093 | 2/1996 | Koepke | 364/571.01 |
| 5,520,115 | 5/1996 | Braun | 102/215 |
| 5,591,031 | 1/1997 | Monk et al. | 434/14 |

OTHER PUBLICATIONS

David P. Van Cleve: Weapon Simulators—30th Annual Autotestcon conference, IEEE, Sep. 1994.

*Primary Examiner*—Jacques Louis-Jacques

*Attorney, Agent, or Firm*—Charles D. Brown; Wanda Denson-Low

[57] ABSTRACT

A missile is tested by first stimulating the performance of missile built-in tests that are stimulated in service by signals from the launch site, and which tests do not require internal access to the missile. If performance is satisfactory, no further testing is required. If a condition of unsatisfactory missile performance is detected, an access cover is removed, connections are made to internal sources of data, and the built-in tests are repeated in order to determine which internal components caused the unsatisfactory missile performance. The component is repaired. The testing with the access cover removed is repeated, and, if the performance is satisfactory, the access cover is replaced and the testing with the access cover present is repeated.

10 Claims, 3 Drawing Sheets

MISSILE TEST METHOD FOR TESTING THE OPERABILITY OF A MISSILE FROM A LAUNCH SITE

BACKGROUND OF THE INVENTION

This invention relates to the testing of missiles, and, more particularly, to a test method and apparatus for determining the presence of satisfactory or unsatisfactory missile performance and isolating the cause of unsatisfactory missile performance at a component level.

A missile, such as an air-to-air missile carried by an aircraft, is a complex apparatus whose components must be carefully tested during assembly, just prior to service, and even during service. If an unsatisfactory state is detected, it may be possible either to repair the cause of the problem or work around the problem using redundant systems or alternative processing procedures. In other cases, repair or alternative approaches may not be feasible, and the only alternative is not to utilize the missile in conditions requiring complete reliability.

Testing during the manufacturing operation is usually conducted under well-controlled conditions with full access to all components of the missile. The satisfactory missile is thereafter typically shipped and possibly stored for long periods of time at a depot or near the launch site. When the missile is removed from storage, it is usually tested. It is desirably tested again when installed into the launch site.

The testing upon removal from storage or at the launch site—termed "field conditions"—is under much less controllable conditions than that performed at the factory. The testing has access to only that information which can be derived from available external connectors on the missile. Moreover, the field testing has limited objectives. The first is to determine whether the missile is in an operable state. The second is to place the missile into an operable state with relatively straightforward repairs, such as replacement of a component module, if the missile is in an unsatisfactory state.

Tools for accomplishing field testing are available and operable. Some inexpensive test units have very low levels of capability and can indicate only whether the missile is satisfactory according to specific tests that are built into the circuitry of the missile. These test devices typically give no clue as to the cause of a malfunction. Others are highly complex, cost millions of dollars, and can be difficult to maintain under field conditions.

There is accordingly a need for a missile field test apparatus and method that indicates an unsatisfactory operating condition and also aids in the correcting of that operating condition. The present invention fulfills this need, and further provides related advantages.

SUMMARY OF THE INVENTION

The present invention provides a method and apparatus for testing a missile. The approach is particularly suitable for field testing of the missile. Where an unsatisfactory operating condition for the missile system is detected, the present invention allows the isolation of the problem to the section level of the missile. If a faulty component is detected, in many instances it can be replaced by another component or some other straightforward repair can be performed. The missile can then be retested at the section and missile system levels to ensure that the missile is ready for operation. The present apparatus achieves a relatively high test thoroughness using an apparatus that has moderate cost.

In accordance with the invention, a test method is operable with a missile that, in service, is launched from a launch site. The missile has at least two internal component sections and a wiring harness communicating therebetween. There is at least one cover-off missile connector for each of the component sections that is accessible only when a missile access cover is removed. The missile further includes an external missile umbilical connector that, during service operation, communicates with the launch site prior to launch, and a missile data-link receiver that in service operation receives communications from the launch site after launch.

An external test apparatus comprises a test controller. There are at least two test cover-off component-level test lines, one for each of the cover-off missile connectors. Each of the cover-off component-level test lines has a first end in communication with the test controller and a second end with a cover-off component-level test line connector adapted to mate with a respective one of the cover-off missile connectors. The test apparatus further has an umbilical line having a first end in communication with the test controller, and a second end with a test apparatus umbilical connector adapted to mate with the external missile umbilical connector. The test apparatus further includes a test apparatus data-link transmitter in communication with the test controller, a power supply and control circuit that provides to the test controller power levels available to the missile from the launch site during service operation, and a pneumatics supply controllable by the test controller. The pneumatics supply is operable to pneumatically unlock and to allow operation of electromechanical components of the missile.

The test apparatus is used by first performing a cover-on test sequence. An operator connects the test apparatus umbilical connector to the external missile umbilical connector, and positions the test apparatus data-link transmitter in a position to communicate with the missile data-link receiver. Upon command, the test controller stimulates performance of missile built-in tests through the umbilical line and the missile data-link receiver, and evaluates the results of the missile built-in tests to determine the presence of an unsatisfactory missile test performance.

In the event of the detection of unsatisfactory missile performance, a cover-off test sequence is performed. The operator removes the missile access cover, and connects each cover-off component-level test line connector to the respective cover-off missile connector. The test controller stimulates performance of missile built-in tests through the umbilical line and the missile data-link receiver, this time gathering data through the test apparatus cover-off component-level test lines, and evaluates the results of the missile built-in tests to isolate the cause of the unsatisfactory missile performance at the component level.

In many cases, the cover-off tests permit fault isolation to one of the components or the wire harness. The cause of the unsatisfactory condition is repaired, where possible using available resources. The test apparatus is thereafter used in a reverse order sequence from that discussed above: first a second cover-off test performed to be certain that the missile components are operable and then a second cover-on test to be certain that, after the access cover is again closed, the missile performance is satisfactory.

The approach of the invention provides a combination of optimal use of available built-in missile tests and flexibility in selecting other tests. The basic missile functionality is determined with the built-in tests that are pre-programmed and wired into the missile. These tests are designed so that the launch site can test missile functionality in its pre-launch state through the missile umbilical and in its post-launch state through the data link.

The present method stimulates the missile pre-launch built-in tests by simulating the launch site operation in this regard, with the access cover closed. If a problem is found, the access cover is opened, additional connections are made to internal connectors within the missile, and the two built-in tests are repeated. With the additional data that is obtained, it is often possible to isolate the cause of the unsatisfactory operation to the extent that a repair can be made.

The invention permits a variety of additional data to be obtained in the cover-off testing. In a typical missile, there is a guidance section, a control section, and a wire harness connecting the two sections and communicating with the external umbilical connector. For example, many problems in the guidance section can be detected by monitoring the telemetry test data during the built-in test. Typical problems in the control section can be identified by unlocking and moving the control surfaces of the missile (using the pneumatic pressure from the pneumatics supply and control signals from the test controller) while monitoring the position indicators of the control surfaces. The wire harness may have become disconnected at some location, and a continuity test between the guidance section and the control section can locate this problem. External communication at launch can be evaluated by simulating a launch cycle. The specific types of data that are most useful are gathered and analyzed for unsatisfactory operation of the missile components. The specific data selected will depend upon the missile system being analyzed and the relative probabilities of different types of malfunctions in that missile system.

The present invention thus provides a test apparatus and method for its use that achieves a high test thoroughness at relatively moderate cost. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
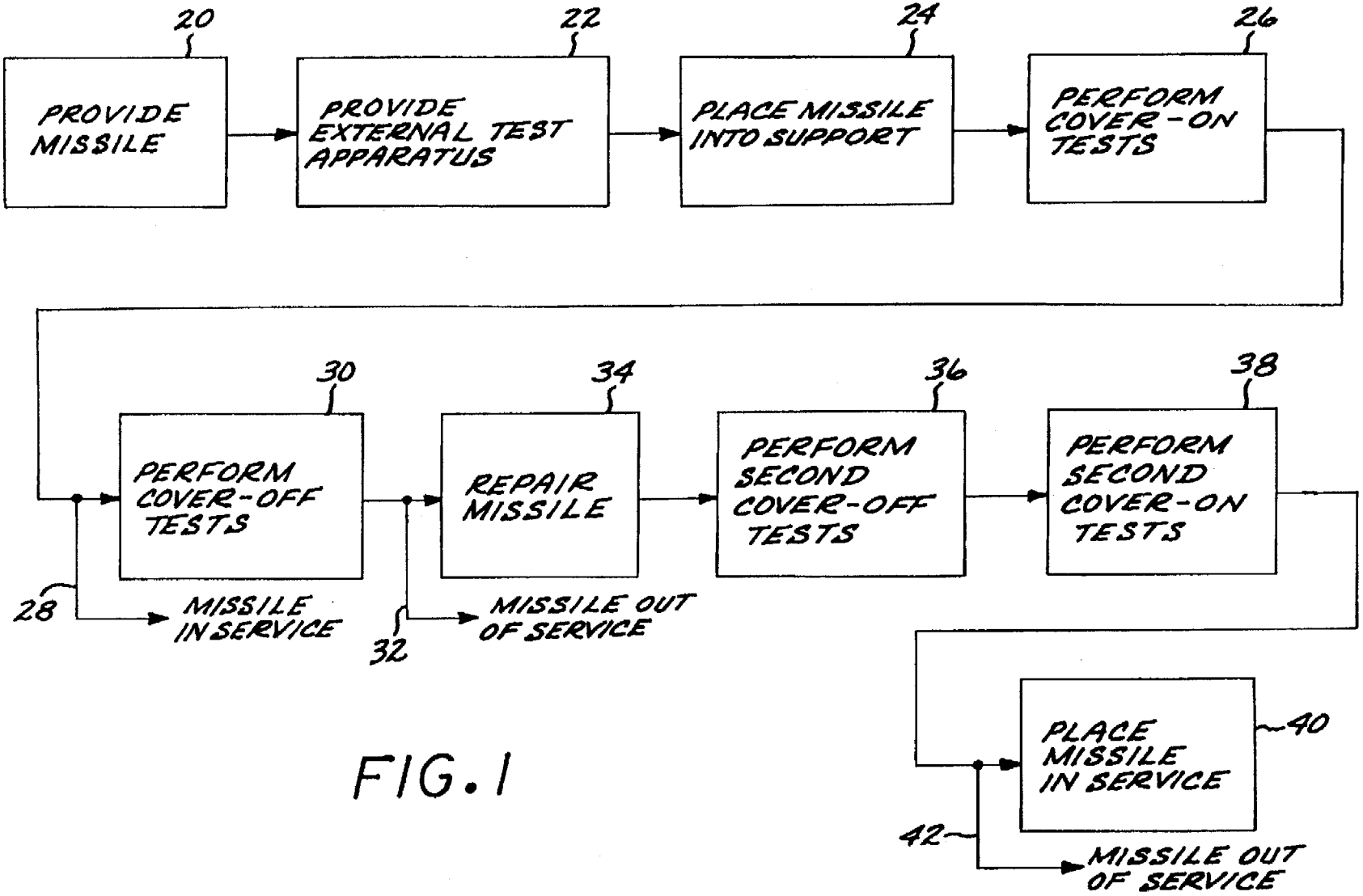
FIG. 1 is a block diagram illustrating the method of the invention.
Figure 2:
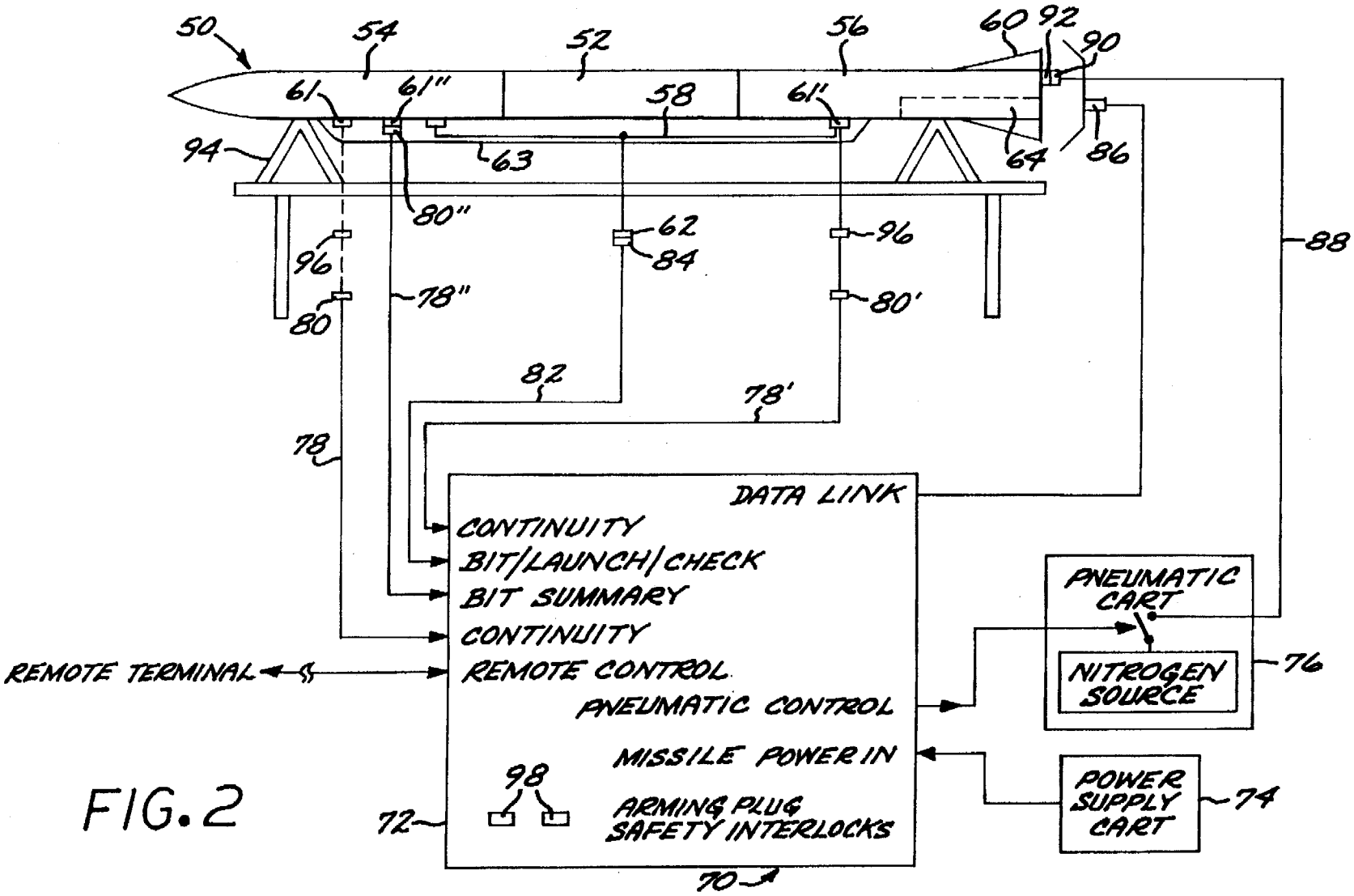
FIG. 2 is a schematic diagram of the apparatus of the invention.

FIG. 1 depicts a preferred embodiment of a method according to the invention, and FIG. 2 illustrates the missile and test apparatus, and their mode of interconnection during testing.

A missile 50 is provided, numeral 20. In its normal service, the missile is launched from a launch site, which can be an aircraft, a ground station, or a naval vessel. The missile 50 includes a missile body 52 and internal structure enclosed within the body. There are a number of subsystems within the missile, but for the purposes of understanding the present invention the missile 50 may be viewed as having a guidance section 54, a control section 56, and a wiring harness 58 that extends between the two sections 54 and 56. The guidance section 54 includes a target seeker in the nose of the missile and the electronics required to communicate with the launch site or other location. The control section includes a propulsive engine such as a rocket motor and movable control surfaces 60 that may be rotated by unlocking the pneumatic actuators and providing a stimulus in order to guide the direction of the missile 50. The wiring harness 58 achieves electrical communication between the sections 54 and 56.

There is at least one, and typically several, cover-off missile electrical connectors 61 provided for each of the component sections. The cover-off missile connectors are physically inside the body 52 of the missile 50, and are protected by a missile access cover 63. Preferably, a single access cover 63 extends over the guidance section connectors at the front of the missile, the wiring harness, and the control section connectors near the rear of the missile. Access to the cover-off missile connectors 61 is gained by removing the access cover 63 over the connectors. The cover-off missile connectors 61 provide electrical communication with various types of information and data, as will be discussed later in relation to specific cover-off tests to be performed.

In service, prior to launch the missile 50 communicates with its launch site through an umbilical connector 62 that is accessible on the side of the body 52 of the missile 50. Internally, the umbilical connector communicates with the wiring harness 58 so that signals can be communicated between the guidance section 54 and the launch site, and between the control section 56 and the launch site. At the time of launch, an external umbilical line (not shown) leading to the launch site is separated from the umbilical connector 62. After launch, the missile 50 receives communications from the launch site (or other location from which information is received) through a missile data-link receiver 64. The receiver 64 preferably operates through a rearwardly facing antenna and a radio frequency beamed signal, but could alternatively be a fiber optic receiver or other type of receiver, or a transceiver permitting two-way communication between the missile and the launch site.

An external test apparatus 70 is provided, numeral 22. The test apparatus 70 preferably comprises three major components, a test controller 72, a power supply 74, and a pneumatic supply 76. The interior components and circuitry of the test controller 72 depend to some extent upon the exact type of cover-off testing that is to be performed, and those components and circuitry will be described later for a preferred embodiment.

At least two test cover-off component-level test lines 78 are provided, one for each of the cover-off missile connectors 61. Each cover-off component-level test lines 78 has a first end in communication with the test controller 72 and a second end having a cover-off component-level test line connector 80 adapted to mate with a respective one of the cover-off missile connectors 61. In FIG. 2, three test lines 78, 78', and 78" are indicated. The test lines 78 and 78" communicate with respective connectors 61 and 61" in the guidance section 54, and the test line 78' communicates with its respective connector 61' in the control section 56. The test lines 78 and 78' are used in system communication testing, and the test line 78" is used in detailed evaluation of the guidance controller, as will be described subsequently. Additionally, the test line 78' contains connections to the control section 56.

An umbilical line 82 has a first end in communication with the test controller 72 and a second end having a test apparatus umbilical connector 84 adapted to mate with the missile umbilical connector 62.

The test apparatus 70 includes a test apparatus data-link transmitter 86 in communication with the test controller 72. The test apparatus data-link transmitter 86 is selected to be compatible for achieving communication with the missile data-link receiver 64 when the two are placed in facing relation (for a radio frequency beamed communication) or otherwise placed into a communicating relationship. In this form, the data-link transmitter 86 includes a radio transmitting antenna mounted in a hood (which is lined with anechoic material) that is placed in facing relation to the antenna of the missile data-link receiver 64. In the event that the post-launch communication of the launch site with the missile 50 is by other means, the transceivers are of the appropriate type, such as an optical-fiber transceiver.

The power supply and control circuitry 74 provides to the test controller 72 power to operate the test controller 72 and the power that the test controller 72 requires to perform specific tests of the missile 50. For example, it may be necessary to transmit power of a particular type from the test controller 72, through the umbilical line 82, and to the missile 50 in order to cause specific events and tests to occur. The power supply and control circuitry 74 provides all required power. Specific instances will be discussed subsequently in relation to preferred embodiments.

The pneumatics supply 76 is controllable by the test controller 72 to provide pneumatic pressure to the missile 50 to unlock the control surfaces. Once unlocked, testing of the components requiring electrical or pneumatic actuation, specifically the motors that operate the control surfaces, is accomplished. A pneumatic line 88 extends from the pneumatic supply 76 to a pneumatic connector 90 that mates with a matching missile pneumatic connector 92 on the missile 50.

The missile 50 is desirably, but not necessarily, placed into a missile support cradle 94 to accomplish the testing, numeral 24. The missile support cradle 94 supports the missile at its structurally strongest points, leaving free access to connectors and covers. Alternatively, the missile 50 could be tested at other locations such near the launch site (i.e., a munitions bunker) or stored in a shipping container.

A cover-on test is performed, numeral 26. "Cover-on" and "cover-off" refer to whether the access cover 63 is installed or removed. A cover-on test is quick to perform, and with the access cover installed only those missile connections which are externally accessible in normal service are available for testing. The cover-on test provides an overall report as to whether the missile is ready for firing.

Figure 3:
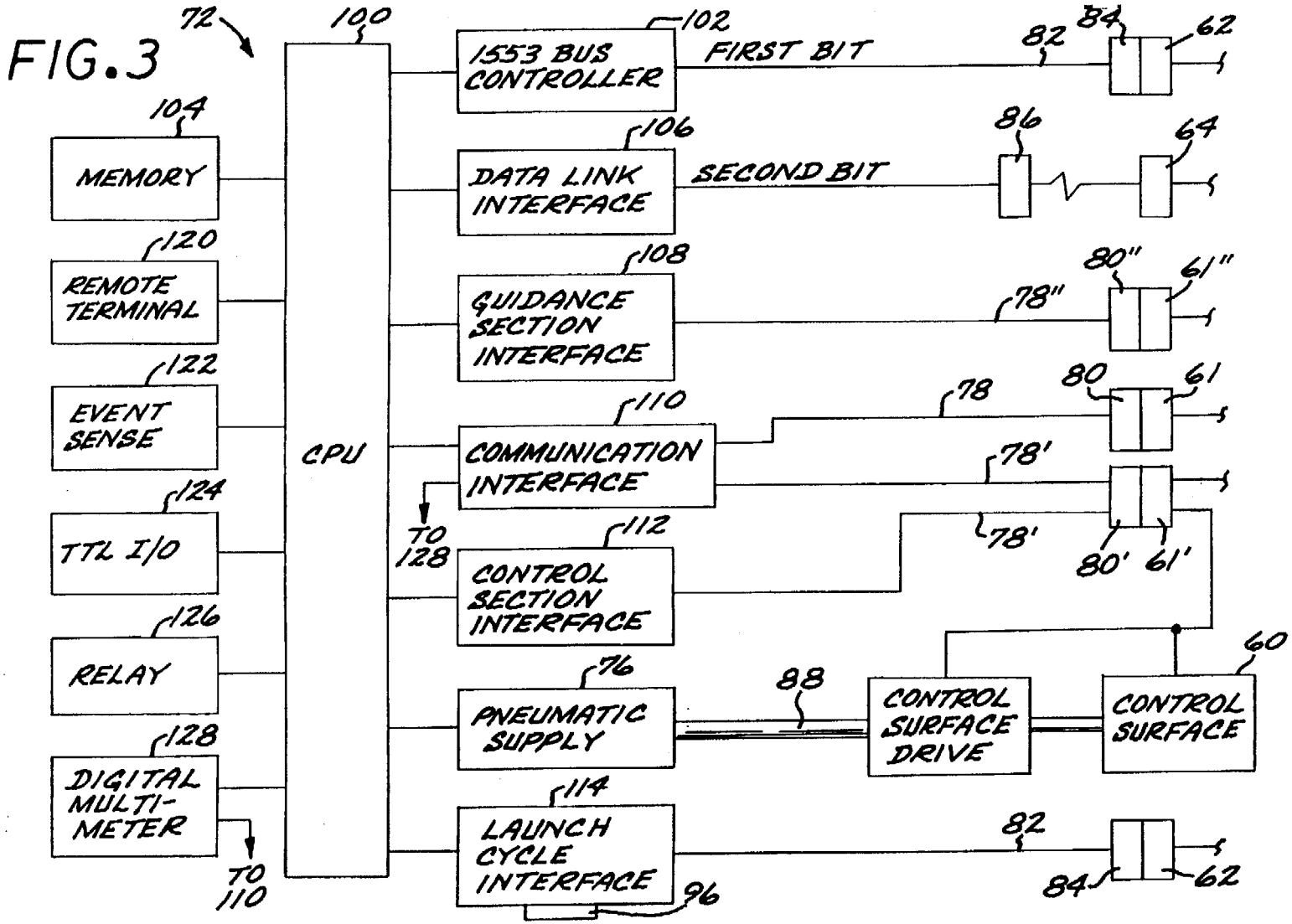
FIG. 3 is a schematic diagram of the test controller.

In the preferred cover-on test, a test operator connects the umbilical connector 84 to the connector 62 and positions the antennas of the transmitter 86 and the receiver 64 in a communicating relationship. (The external pneumatic line 88 is not connected at this point.) The test controller 72 stimulates the missile 50 to perform its own built-in tests (BIT). By "stimulates" is meant that the test controller 72 causes the built-in tests to be performed by providing the correct external stimuli. A first built-in test (3-second BIT) of the pre-launch electronics involves supplying 400 Hz power from the power supply 74, through the test controller 72, through the umbilical line 82, and to the missile 50, at the same time that a release consent signal is inactive. The guidance section 54 recognizes this combination of signals to call for commencement of the first built-in test. Referring to FIG. 3, the first built-in test is accomplished when a central processing unit (CPU) 100, preferably in the form of a 486-based microcomputer, commands a MIL-STD-1553 bus controller 102 to communicate a 400 Hz power signal and lack of release consent through the umbilical line 82 to the missile 50 through the umbilical connectors 84 and 62. The umbilical line 82 includes the associated 1553 coded serial data bus for the bus controller 102. As the missile 50 performs its first built-in test, the CPU 100 receives from the missile 50 through the umbilical line 82 and the bus controller 102 the missile actions and responses, which are stored in an associated memory 104. If the first built-in test yields satisfactory results, it is concluded that the guidance section 54 of the missile 50 is operating properly and communicating with the wiring harness 58. If the first built-in test is not satisfactory, it is concluded that either the guidance section 54 is not operating properly or that it is not communicating with the wiring harness 58.

A second built-in test (5-second BIT) reruns the first built-in test (3-second BIT) described above and is extended for an additional 2 seconds to allow the tester to transmit data link messages, in order to have the missile perform a more-thorough BIT. The second built-in test is performed only if the first built-in test was satisfactory. The missile is not actually launched. Instead, the test apparatus 70 simulates the operation of the launched missile, primarily the use of the data link receiver 64, so that the flight systems can be tested prior to the missile being launched. An underlying presumption of the second built-in test is that the missile 50 is receiving rear data-link information through the receiver 64 as it would in a post-launch condition, except that communication through the 1553 bus controller 102 is still active. The testing of post-launch communication with the missile 50 is therefore accomplished using the data link 64/86. An appropriate data-link interface 106 is provided. Such interfaces 106 are known, and are used in the launch site controller in conventional operation to communicate with the missile through the data link 64. The CPU 100 receives from the missile 50 through the 1553 bus controller 102 and the interface 106 the missile actions and responses, which are stored in the associated memory 104. If the second built-in test yields unsatisfactory results (after the first built-in test yielded satisfactory results), it is concluded that a defect exists in the data-link system which communicates between the wiring harness 58 and the test controller 72 through the data link 64.

The two built-in tests themselves are well known in the art, and are provided within the internal hardware and software of sophisticated missile systems to permit self-testing of the missile subsystems responsive to the appropriate external stimulus. A built-in test is stimulated by the launch site to check that the missile is ready for launch. In this case, the test apparatus 70 stimulates the built-in test. The built-in tests are performed very quickly, in 3–5 seconds each, so that repetitions of the built-in tests do not impose significant delays. A virtue of the present invention is that it operates in conjunction with available built-in tests.

As the built-in tests are performed, the test controller 72 receives the results of the built-in tests through the umbilical line 82. If the two built-in tests are satisfactory and thereby indicate that the missile is fully operational, the missile is judged to be in service, numeral 28. If, on the other hand, there is an indication of either degraded performance or a complete failure, the missile is judged to be in unsatisfactory condition. In some instances, the results of the built-in tests can be used to determine the nature of and effect an immediate repair of the missile in the event that the specific fault is identified by the built-in tests. In that case, the missile is repaired, as by replacing the indicated faulty component, and the cover-on test 26 is repeated.

The information from the built-in tests does not, however, indicate in some instances the reason(s) for the unsatisfactory condition—only its presence—and further testing to isolate the cause of the problem and possible corrective action are required. In the event that an unsatisfactory condition is detected, a cover-off test is performed, numeral 30. In this test, the test operator removes the missile access cover 63 and connects one or more of the connectors 80 to its respective connector 61. The test controller 72 stimulates the performance of the first and second built-in tests. (The previously described interfaces and performance of the first and second built-in tests are therefore maintained for this portion of the testing.) In this instance, additional data is available to the test controller 72 concerning the response of the various subsystems within the missile through the cover-off component-level test lines 78.

The data available in the cover-off testing, in addition to that available and previously described by the first and second built-in tests, is generally of three types. The specific operation of the guidance section 54 is available through the test line 78", connected to the guidance section 54 through the plugs 80"/61". Second, the communication of information through the harness 58 is available via a continuity check performed between the test lines 78 and 78', functioning through their respective connectors 80/61 and 80'/61'. For example, if the first built-in test is performed and the guidance section test line 78" indicates a failure, the fault is tracked to that portion of the system. On the other hand, if during that test the guidance section test line 78" indicates proper operation of the guidance section 54 and the communication check between the lines 78 and 78' indicates a lack of communication from the guidance section 54 through the harness 58, the fault is tracked to that portion of the system. The third type of data is that related to the operation of the control section 56, obtained through some of the lines within the test line 78' and its associated connectors 80'/61'. This type of data includes, for example, position controllers that allow electrical activation of drives for the various control surfaces 60 and position sensors that sense the actual extent of movement of the control surfaces 60. These controllers and sensors are normally a part of the missile control section.

Referring to FIG. 3, the check of the controller is performed by the CPU 100 by receiving information from the guidance section 54 through a guidance section interface 108. The interface 108 communicates with the guidance section 54 through a standard serial interface card, the test line 78" and its associated plugs 80"/61". The CPU 100 performs the communication check using a communications interface 110 which effectively applies test signals between the test lines 78 and 78', through their respective plugs 80/61 and 80'/61'. The test signals are of two types. In one, a voltage is simply applied to determine continuity, to discover if the fault is based simply on a loose wire or connector in the wiring harness, for example. In the other, a coded digital signal is transmitted to determine whether, if continuity is present, some fault is causing a degradation of the shape or amplitude of digital signals communicated through the wiring harness 58 and its associated internal connectors.

The check of the control section 56 is accomplished by the CPU 100 causing activation of the pneumatic supply 76 to unlock the control surfaces 60 and transmitting electrical commands to control surface drives to move the control surfaces. The position of the control surfaces 60 is sensed as feedback voltages (generally proportional to shaft position) and communicated back to the CPU 100 through a control section interface 112, operating through lines in the test line 78' and its connectors 80'/61'. The control surface position controllers are typically analog signals, and the controller interface 112 therefore includes a digital-to-analog converter to convert these signals into an analog form. Thus, for example, according to the logic of the test if the command signal is reaching a particular control surface drive but its shaft does not move, the fault is isolated to the operation of the drive.

The specific types of additional data that are available through the guidance section test (test line 78") will depend upon the experience with a particular missile type as to its most probable failure modes. A particular missile system will have components in the guidance section 54 that are most susceptible to failures, and the guidance section test procedures are selected to evaluate whether those most-likely failures have occurred. A virtue of the present invention is that the specific testing for most-likely failure situations and combinations of events can be programmed into the CPU 100 and provided for through the specific pin connections in the line 78" and connectors 80"/61". Some examples that are most likely to be experienced in some types of missiles can be mentioned. The telemetry built-in test data stream in the guidance section 54 is monitored and provided to the CPU 100 as a coded data stream. This test data provides a more comprehensive basis for identifying whether the unsatisfactory condition is caused by specific component in the guidance section, and the particular component that is causing the problem. Similarly, a specific test of the control section 56 is performed by attempting specific movements in the control surfaces 60 by commanding operation of the pneumatic supply 76 and providing electrical stimulus, and measuring whether the control surfaces have moved to the desired locations, as previously described.

One of the cover-off tests, a launch cycle test, requires great care and caution. The tests described to this point do not involve tests of signals that could cause the missile to actually fire or to otherwise irreversibly change its state. Arming plugs 96 physically permit operation of the missile by connecting command signals to service devices that operate during launch and flight of the missile. Examples of these command signals include squib pulses to fire batteries, squib pulses to actuate a launcher, and a rocket motor firing command. To conduct a launch-cycle test, each arming plug 96 is removed from the missile and inserted into a receptacle 98 in the test controller 72. The signal from the test controller 72 which would otherwise stimulate performance of a built-in test now stimulates the launch sequence, except that the firing signals are received by the test controller 72 rather than their service device. The installation of the arming plugs 96 in the test controller 72 prevent the actual launch of the missile.

Referring to FIG. 3, the CPU 100 commands operation of a launch-cycle controller 114. The launch-cycle controller 114 includes the arming-plug receptacles 98, into which the arming plugs 96 must be physically inserted for the launch-cycle test to be performed. With the arming plugs 96 removed from the missile 50, the internal launch command is open-circuited, so that an actual launch cannot occur. When the arming plugs 96 are inserted into the receptacles 98, the launch-cycle controller generates, under command of the CPU 100, a launch consent signal. The first and second built-in tests are performed with the application of 400 Hz power and with launch consent (but with launch command physically blocked by the absence of the arming plugs in the missile), whereas previously they were performed without launch consent. With launch consent present, it is possible to check for additional missile operational features such as voltages on signals that would enable the batteries of the missile, fire internal squibs, and fire the rocket motor of the missile.

In its preferred form, the test controller 72 operates according to the standard VXI architecture using available support capabilities used to enable the functions and components discussed previously, and to permit their analysis. The CPU 100 is preferably a programmable 486 computer, which can be provided with a remote terminal 120 for operation and/or data processing. That is, if desired, the entire testing process can be controlled remotely, or data can be transmitted to a remote site for more-detailed analysis than possible within the CPU 100. An event sense card 122 includes a clock that senses relative timing of events such as the time sequences required in the missile launch and a time-tagging capability to determine the timing interrelation of events. The actual sensing of the events is accomplished as discussed previously, as through the guidance interface 108, but the event sense card allows the timing interrelations to be evaluated. A TTL I/O logic card 124 generates discrete signals required by the CPU and the interfaces to accomplish events. Such discrete signals are used, for example, to modulate the voltage levels provided by the power supply 74 that are sent to the missile through the umbilical line 82. A relay switching card 126 is operated by the CPU 100 to switch continuity check signals from the communications interface 110 to a digital multi-meter 128 that measures voltages. These voltages are in turn communicated back to the CPU 100 for assessment.

The cover-off tests are performed sequentially, with the BIT tests being repeated first, followed by the launch cycle tests, control section tests, and continuity tests, until a cause for the unsatisfactory performance is found. If the fault is detected during one of the tests, further testing is suspended until that problem is corrected. If no cause is identified or a cause is identified and cannot be remedied with the available repair resources, the missile is placed out of service, numeral 32. On the other hand, if one of the cover-off tests identifies the source of the problem and that source can be corrected with available capabilities, the missile is repaired, numeral 34. Repair often involves removing a faulty module or card and replacing it with a functional module or card.

A second cover-off test is performed, numeral 36. The second cover-off test 36 is similar to the cover-off test 30 in respect to the tests conducted. The purpose of making a second cover-off test is to verify that the unsatisfactory condition has been remedied, while the missile access cover 63 is still off. It is possible that the unsatisfactory condition could have been caused by multiple faulty components, or that one problem masked another problem. Repeating the cover-off test identifies such conditions. If the built-in tests locate no further unsatisfactory conditions, the operator disconnects the connectors 80 and 61, reinstalls the arming plugs 96 in the missile, and replaces the missile access cover 63.

A second cover-on test is performed, numeral 38. The built-in tests are stimulated by the test controller 72. If the test results are satisfactory, the umbilical line 82 is disconnected, the data-link transmitting antenna 86 and hood are removed, and the missile is placed into service, numeral 40. If the test results are not satisfactory, the missile is taken out of service, numeral 42, with a problem that cannot be detected and repaired by the present approach.

The present invention has been reduced to practice in a simulation for a specific missile type, the advanced medium-range air-to-air missile (AMRAAM) having known types of failure modes and failure probabilities. It has been estimated that, for a relatively modest cost for the readily portable test apparatus 70, a 92 percent test thoroughness is achieved. A more complex test apparatus, costing about 10 times as much and being much less portable, achieves a 96 percent test thoroughness. Thus, the present approach achieves nearly as good a test thoroughness but at far less cost and greater portability.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for testing the operability of a missile during service operation, comprising the steps of:

providing said missile that, during service operation, is to be launched from a launch site, the missile having at least two internal component sections and a wiring harness communicating therebetween, there being at least two cover-off missile connectors, one for each of said at least two internal component sections being accessible only when a missile access cover is removed, an external missile umbilical connector that, during service operation, communicates with the launch site prior to launching of said missile, and a missile data-link receiver that, during service operation, communicates with the launching of said missile site after launch;

providing an external test apparatus comprising a test controller, at least two test cover-off component-level test lines, one for each of the at least two cover-off missile connectors, each of said at least two cover-off component-level test lines having a first end m communication with the test controller and a second end having a cover-off component-level test line connector to mate with a respective one of the at least two cover-off missile connectors, an umbilical line having a first end in communication with the test controller and a second end having a test apparatus umbilical connector to mate with the external missile umbilical connector, a test apparatus data-link transmitter in communication with the test controller, a power supply that provides to the test controller power levels available to the missile from the launch site during service operation, and a pneumatics supply controlled by the test controller, the pneumatics supply being operated to pneumatically unlock and to allow operation of electromechanical components of the missile;

performing a cover-on test sequence by an operator connecting the test apparatus umbilical connector to the external missile umbilical connector, the operator positioning the test apparatus data-link transmitter in a position to communicate with the missile data link receiver, the test controller stimulating performance of missile built-in tests through the umbilical line and the missile data-link receiver, and the test controller evaluating the results of the missile built-in tests to determine the presence of an unsatisfactory missile test performance; and, in the event of the detection of an unsatisfactory missile performance; and performing a cover-off test sequence by the operator removing the missile access cover, the operator connecting each cover-off component-level test line connector to the respective cover-off missile connector, and the test controller stimulating performance of missile built-in tests through the umbilical line and the missile data-link receiver and gathering data through the test apparatus cover-off component-level test lines, and the test controller evaluating the results of the missile built-in tests to isolate the cause of an unsatisfactory missile performance at a component level.

2. The method of claim 1, including an additional step, after the step of performing the cover-off test sequence, of the operator repairing at least one component of the missile.

3. The method of claim 2, including the additional steps, after the step of the operator repairing, of performing a second cover-off test sequence by the test controller stimulating performance of missile built-in tests through the umbilical line and the missile data-link receiver and gathering data through the test apparatus cover-off component-level test lines, and the test controller evaluating the results of the missile built-in tests to determine if the cause of the unsatisfactory missile performance at the component level has been corrected, and, if the cause of the unsatisfactory missile performance at the component level has been remedied, the operator disconnecting each cover-off component-level test line connector from the respective cover-off missile connector, and the operator replacing the missile access cover.

4. The method of claim 3, including the additional steps, after the step of performing a cover-off test sequence, of performing a second cover-on test sequence by the test controller stimulating performance of missile built-in tests through the umbilical line and the missile data-link receiver, the test controller evaluating the results of the missile built-in tests to determine whether the cause of the unsatisfactory missile test performance has been corrected, and, in the event that the cause of the unsatisfactory missile test performance has been corrected;

an operator disconnecting the test apparatus umbilical connector from the external missile umbilical connector; and the operator removing the test apparatus data-link transmitter from a position to communicate with the missile data link receiver.

5. The method of claim 1, wherein in the step of providing said missile said missile includes a guidance section, a control section, and the wiring harness extending therebetween.

6. The method of claim 5, wherein the step of performing a cover-off test sequence includes the step of monitoring a telemetry built-in test data stream from the guidance section.

7. The method of claim 5, wherein the step of performing a cover-off test sequence includes the step of simulating a launch cycle.

8. The method of claim 5, wherein the step of performing a cover-off test sequence includes the steps of utilizing the pneumatic source to unlock a control surface of the control section, and the test controller for monitoring the movement of the control surface.

9. The method of claim 5, wherein the step of performing a cover-off test sequence includes the steps of performing a continuity check of the wiring harness.

10. The method of claim 1, wherein in the step of providing said missile said missile, during service operation, is launched from an aircraft.

* * * * *